United States Patent [19]

Takano

[11] Patent Number: 4,743,941

[45] Date of Patent: May 10, 1988

[54] COPYING APPARATUS CAPABLE OF FEEDING COPY PAPER MANUALLY

[75] Inventor: Yoshiaki Takano, Toyokawa, Japan

[73] Assignee: Minolta Camera Kabushiki Kaisha, Osaka, Japan

[21] Appl. No.: 934,635

[22] Filed: Nov. 25, 1986

[30] Foreign Application Priority Data

Dec. 7, 1985 [JP] Japan ..... 60-274335

[51] Int. Cl.[4] ..... G03G 15/00

[52] U.S. Cl. ..... 355/3 SH; 355/14 SH

[58] Field of Search ..... 355/3 SH, 3 R, 14 SH, 355/14 R, 14 C

[56] References Cited

U.S. PATENT DOCUMENTS

| | | | |
|---|---|---|---|
| 3,649,114 | 3/1972 | Vlach et al. | 355/3 R |
| 4,383,756 | 5/1983 | Hanamoto et al. | 355/14 SH |
| 4,392,740 | 7/1983 | Ito et al. | 355/3 SH |
| 4,572,653 | 2/1986 | Ito et al. | 355/14 R |
| 4,611,904 | 9/1986 | Wada | 355/14 SH |
| 4,666,281 | 5/1987 | Miyai et al. | 355/3 SH |

*Primary Examiner*—Peter S. Wong

*Attorney, Agent, or Firm*—Burns, Doane, Swecker & Mathis

[57] ABSTRACT

A copying apparatus provided with an automatic paper feeding mechanism capable of feeding paper manually, wherein a manual paper feeding passage is connected to a copy paper transporting passage of the automatic paper feeding mechanism, and a plurality of sensors are provided in the way of paper feeding passage to detect the inserting state of a manually fed copy paper. When a manually fed copy paper is inserted to a predetermined position of the manual paper feeding passage, the sensors detect the state of insertion and display them to let an operator know that the copy paper has been inserted to the predetermined position and state an image forming operation. If the manually fed copy paper has been pulled out after the image forming operation was started, the image forming operation is executed on the minimum size of the copy paper.

14 Claims, 7 Drawing Sheets

COPYING APPARATUS CAPABLE OF FEEDING COPY PAPER MANUALLY

BACKGROUND OF THE INVENTION

1. Field of the Invention

This invention relates to a copying apparatus which is provided with an automatic paper feeding mechanism and which can also feed a copy paper by manual operation.

2. Description of the Prior Art

Some electrophotographic copying apparatuses or the like are provided, in addition to a normal automatic paper feeding mechanism, with a mechanism which manually feeds copy paper to meet the demand by users who wish to make copy on a specific paper.

It has been customary to provide a manual copy paper feeding mechanism as described above, which is independent from the automatic paper feeding mechanism as disclosed in, for example, U.S. Pat. No. 4,392,740 Specification of ITO et al.

Copying apparatuses provided with a manual copy paper feeding mechanism have been increased in need even in the field of small type apparatuses. However, the addition of such a manual paper feeding mechanism to the small-type copying apparatus complicates the structure of the apparatus and has involved a difficulty.

Further, U.S. Pat. No. 3,649,114 Specification of Vlach et al discloses a copying apparatus which is designed without a feeding roller for manual feeding of copy paper in order to simplify a manual copy paper feeding mechanism.

In such a copying apparatus without a special manual copy paper feeding mechanism, an operator should positively insert a manual copy paper into the paper feeding mechanism i.e. for example to a timing roller within the copying apparatus. Unless the copy paper is not completely inserted, copying cannot be achieved. It is difficult for an operator to see whether the copy paper has been inserted to a position of the paper feeding mechanism in connection with the copying process, thus making it difficult to proceed a copying operation by manual feeding of copy paper.

SUMMARY OF THE INVENTION

Accordingly, an essential object of this invention is to provide a copying apparatus which can indicate to an operator that a manually fed copy paper has been completely inserted into a paper feeding mechanism in connection with an image forming mechanism.

It is a further object of the invention to provide a copying apparatus which starts an image forming operation when a manually fed copy paper has been completely inserted into a paper feeding mechanism in connection with an image forming mechanism.

It is another object of the invention to provide a copying apparatus in which an image forming operation is executed in a specific mode when a copy paper has been pulled out after the image forming operation started on the manually fed copy paper.

The above and other objects and features of the invention will appear more fully hereinafter from a consideration of the following description taken in connection with the accompanying drawing.

Figure 1:
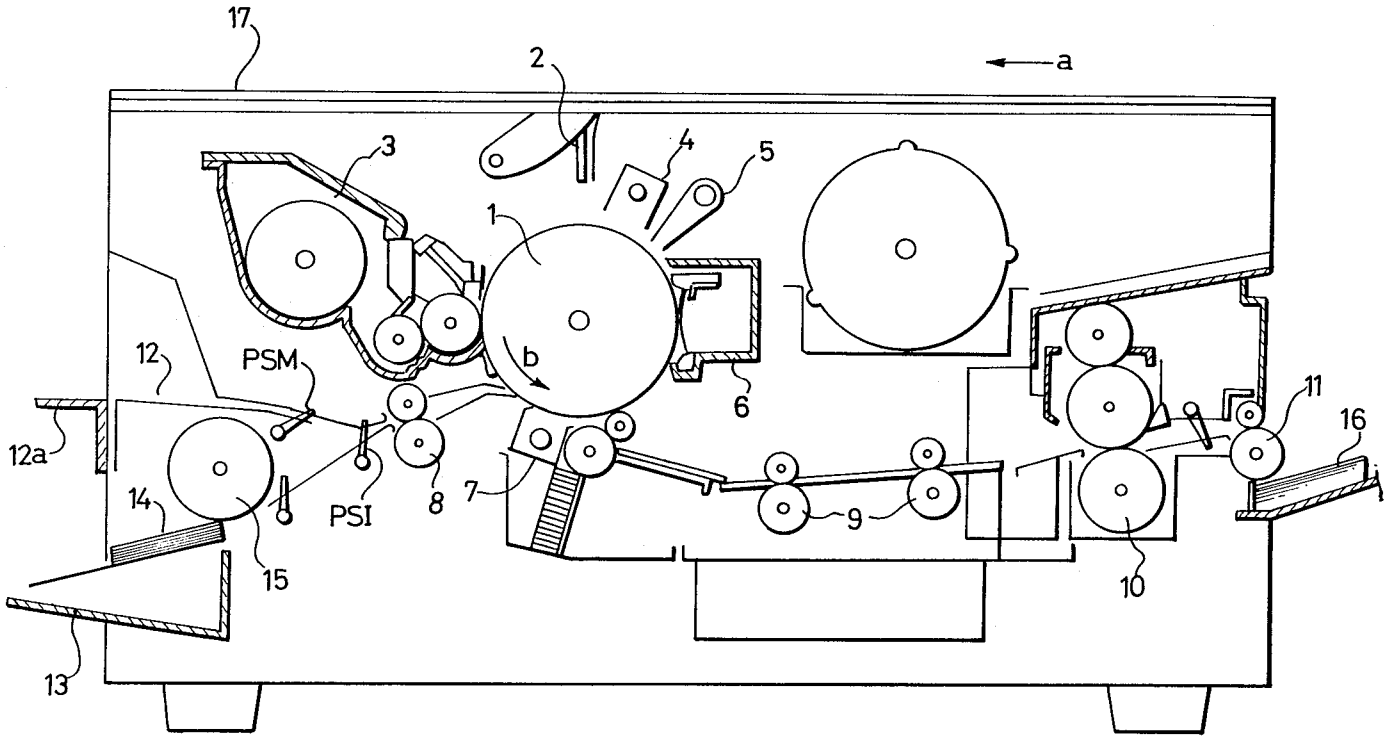
FIG. 1 is a longitudinal sectional front view of a copying apparatus embodying the present invention.
Figure 4:
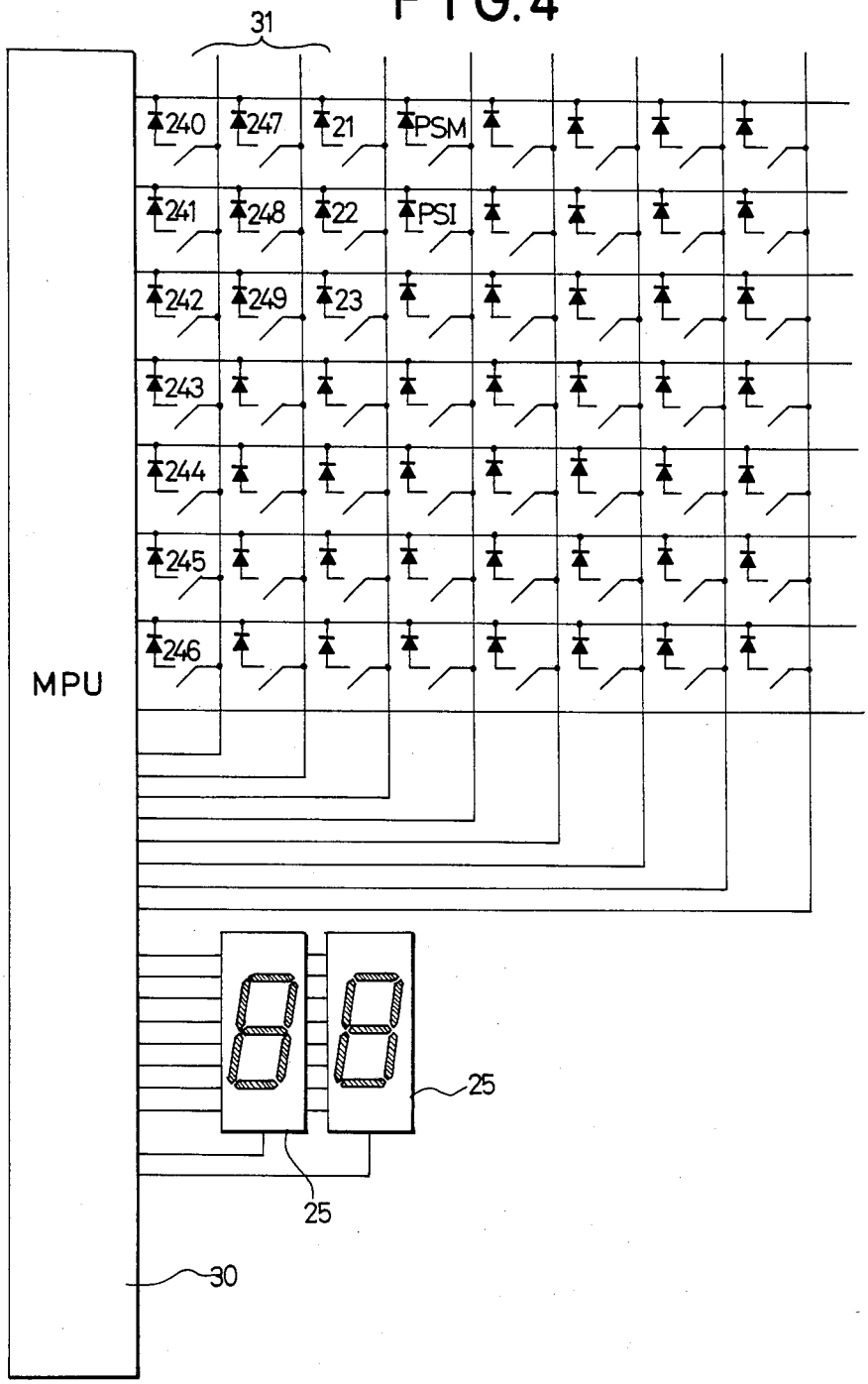
Figure 5:
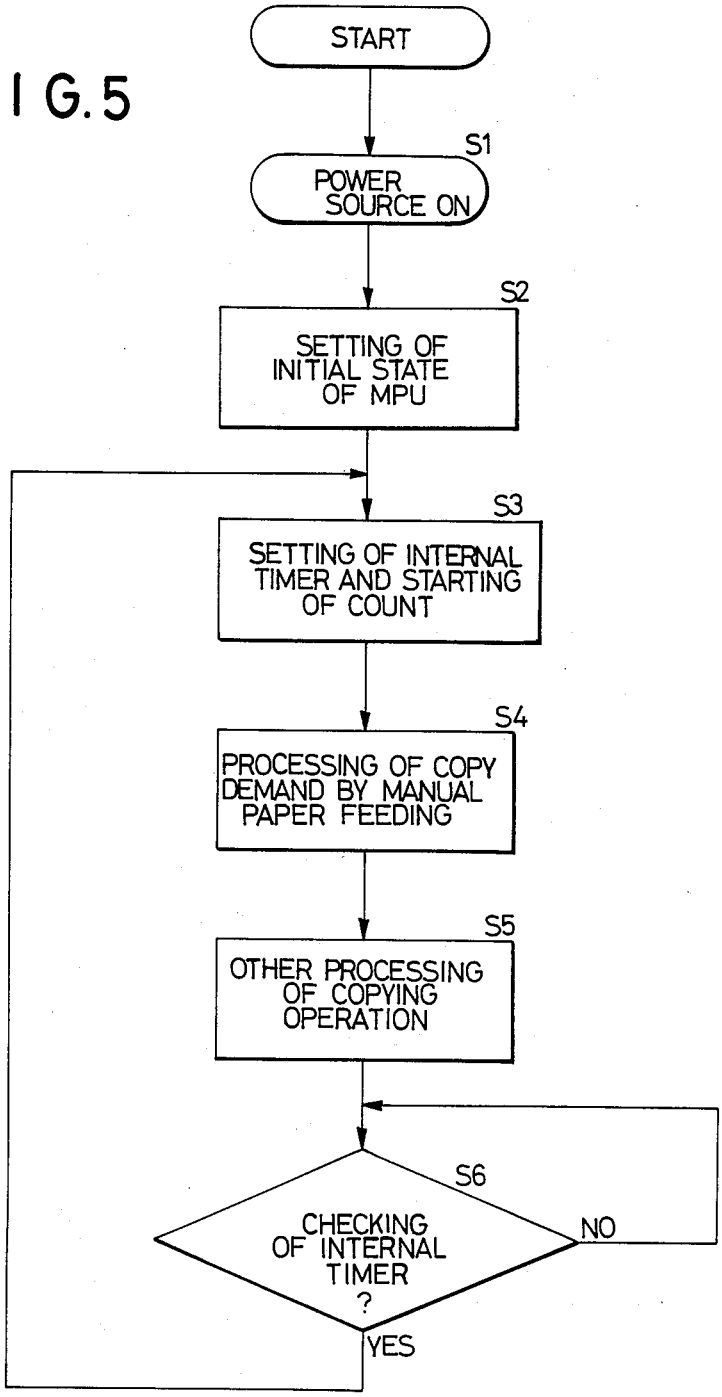
Figure 7:
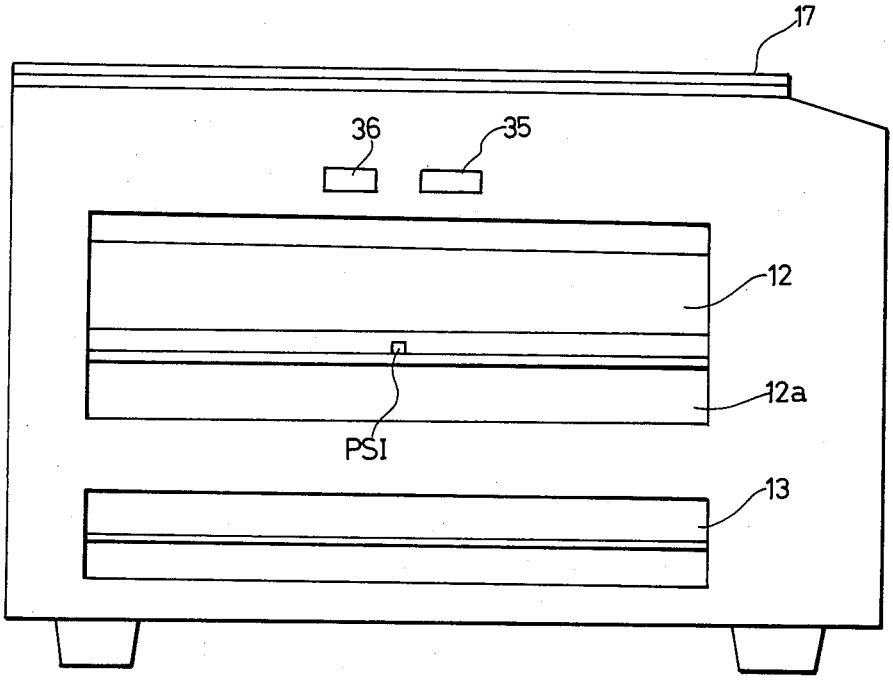

FIGS. *3a* and *3b* are front views showing one example of the displaying state of the display panel;

FIG. 4 is a block diagram of a control circuit of a microprocessor used to control the copying apparatus of FIG. 1, and portions in connection with operating keys and display portion connected thereto;

FIG. 5 is a flow chart showing the sequence of control and processing executed by the microprocessor;

FIGS. *6a* and *6b* are flow-charts of a sub-routine for copying processing in manual paper feeding mode; and FIG. 7 is a side view of a manual paper feeding opening showing the arrangement of indicators in accordance with a second embodiment of a copying apparatus.

DETAILED DESCRIPTION OF THE INVENTION

Embodiments of the present invention will now be described with reference to the drawings. FIG. 1 is a longitudinal sectional front view of a copying apparatus embodying the present invention. The copying apparatus comprises a photosensitive drum 1, an optical system 2 for forming an image of original to be copied on the photosensitive drum, a developing device 3, a charger 4, an eraser lamp 5, a cleaning device 6, a transfer charger 7, a timing roller 8, a transporting roller 9, a fixing device 10, a paper ejection roller 11, a manual paper feeding opening 12, a manual paper feeding table 12*a*, a paper cassette 13, a copy paper 14 within the cassette, a paper feeding roller 15, an ejected paper tray 16, and an original platform 17. Reference characters PSM and PSI denote paper sensors, respectively, for detecting the feeding condition of copy paper.

The operation of the copying apparatus will be described hereinafter.

In this embodiment, the original platform 17 is reciprocatingly moved to leftward and rightward, and when the original platform 17 is moved leftward in FIG. 1 (in a direction as indicated at arrow a), an original placed on the original platform 17 is scanned by the optical system 2. The optical system 2 is composed of an array of converging lenses to project an image of original on the photosensitive drum 1 and an electrostatic latent image is formed on the said drum. The photosensitive drum 1 rotates in a direction as indicated at arrow b, and the electrostatic latent image on the photosensitive drum is developed by the developing device 3.

A toner image of the developed original image is transferred onto a copy paper being supplied by the transfer device 7. The copy paper is transported to the fixing device 10 by the transporting roller 9, where the toner image on the copy paper is fixed by the fixing roller. Then, copy paper is delivered by the ejection roller 11 and discharged into the tray 16.

After the transfer step, a residual toner on the photosensitive drum 1 is removed by the cleaning device 6 and discharged by the eraser lamp 5 to be prepared for the succeeding copying step which starts with charging.

In the case of the automatic paper feeding mode, the copy paper 14 is picked up by the roller 15 and fed to the transporting passage. The copy paper is stopped into contact with the timing roller 8 and awaits there. At that time, the timing roller 8 is not rotated.

An unshown sensor for detecting an original platform position is provided on the moving passage of the original platform and when the original platform arrives at a predetermined position, the sensor is turned ON, and the timing roller starts its rotation by signals from the sensor for feeding a copy paper to the transfer position. Thereby the leading edge of image of original formed on the photosensitive drum 1 and the leading edge of the copy paper are brought into registration with each other to transfer the image of original to a predetermined position of the copy paper.

When the paper sensor PSI detects the trailing edge of the copy paper being fed, the original platform 17 completes its movement in a scanning direction as indicated at arrow a, that is, forward movement, and returns to the scanning starting position. More specifically, the original platform 17 is able to execute the scanning of stroke according to the size of the copy paper.

Next, the feeding of copy paper by manual operation will be described.

In this case, a copy paper is supplied from the manual paper feeding opening 12, and manually inserted to the position immediately before the timing roller 8. A first paper sensor PSM is provided on the feeding passage for the manual feeding copy paper, and second paper sensor PSI is provided in a position in the proximity of the timing roller 8 on the feeding passage.

When a copy paper is inserted and the leading end thereof is detected by the first paper sensor PSM, a first state is displayed on the display portion to let an operator know that the copy paper must be further inserted into a deeper portion. When the copy paper is further deeply inserted and detected by the second sensor PSI, after a lapse of a time for continuing the insertion of copy paper, and copy paper comes into contact with the timing roller, a second state is displayed on the display portion to let an operator know that the copy paper has been positively inserted to ready for starting of copying. By this indication, the operator may know that the inserting operation of the copy paper can be stopped. Then the copying operation is started automatically.

It is noted that a plurality of unshown copy paper detecting means are provided on a copy paper passage from the timing roller 8 to the ejection roller 11, so that when the copy paper is jammed, which is immediately detected and stop the copying operation.

Figure 2:
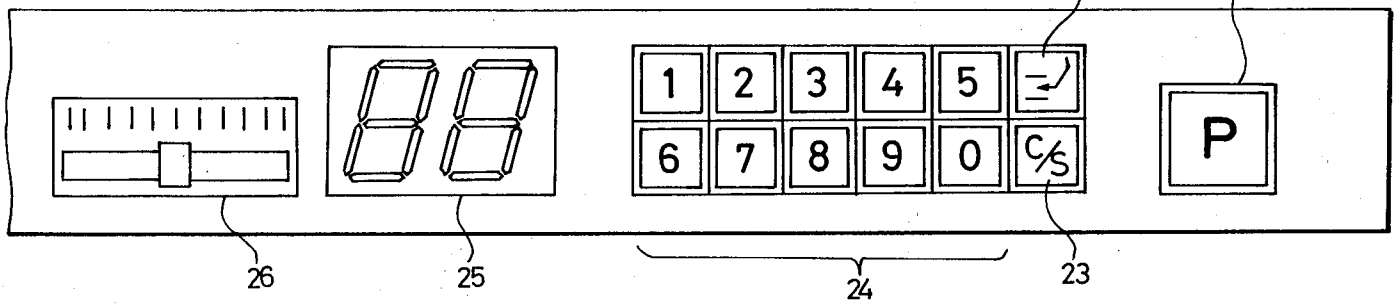
FIG. 2 is a front view showing a part of an operating and display panel of the apparatus shown in FIG. 1.

FIG. 2 shows an operating and display panel of a copying apparatus according to the embodiment of the present invention. The panel comprises a print switch 21 for instructing the copying operation, an interruption copying switch 22, a clear/stop key 23 for instructing the cancel of the number of copies set and the discontinuance of the copying operation, a ten-key 24 for setting the number of copies, and a lever 26 for adjusting a copying density. Reference numeral 25 designates a display portion for the number of copies, but is also used to display the operating condition of the copying apparatus, for example, such as the paper jam or the like. Moreover, in the embodiment according to the present invention, in case of manual paper feeding mode, the display portion 25 also serves to display the state of inserted copy paper.

Figure 3B:
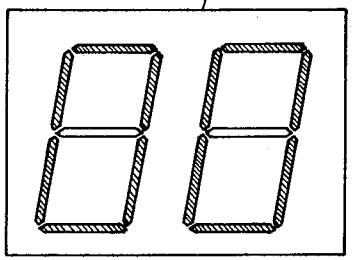
Figure 3A:
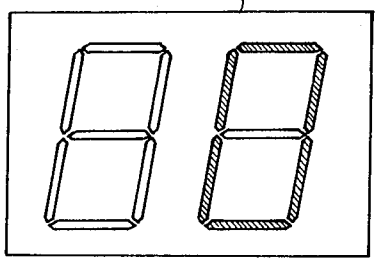

More specifically, when a manually fed copy paper is detected by the first paper sensor PSM, a right-hand display element of the display portion 25 is lighted as shown in FIG. 3(*a*) whereas when the copy paper is detected by the second paper sensor PSI, a left-hand display element of the display portion 25 is lighted as shown in FIG. 3(*b*), thus indicating the state wherein the copy paper is inserted.

FIG. 4 is a block diagram of a control circuit in connection with the operating key and display portion in this embodiment. A micro-processor (hereinafter referred to as MPU) 30 performs the whole control of the copying apparatus.

The MPU is connected with a key matrix 31, the print key 21, the interruption copying key 22, the clear/stop key 23, the ten-key for setting the number of copies (the ten-key 24 being composed of keys 240 to 249), and various other sensors and switches required for the copying operation, for example, such as the first and second paper sensors PSM and PSI for detecting the state of manually feeding copy paper as described previously.

A display portion 25 connected to the MPU displays the number of copies and other information processed by MPU, such as the state detected by the first and second paper sensors PSM and PSI.

In the following, the control of the copying operation in the manual paper feeding mode executed by MPU will be described with reference to flow charts shown in FIGS. 5 and 6.

FIG. 5 is a flow chart showing the sequence of signal processing in MPU.

When a power source is turned on (Step S1), the initial state of MPU is set (Step S2). In this state the number of copy to be copied by the apparatus is set to 1 and the original platform is returned to its start position.

Next, an internal timer in the MPU used in controlling routine is set and start counting (Step S3).

Then, processing of copying demand by manual paper feeding mode is started (Step S4). This routine will be described later in connection with FIG. 6. Thereafter, processing of display and the whole other copying operation are carried out (Step S5).

After completion of the above-described processing, the counted contents of the timer previously set are checked (Step S6), and if the timer indicates a predetermined counted value (which is equal to the lapse of a given time), control returns to the Step S3 and the internal timer is again set and operation is repeated.

Figure 6A:
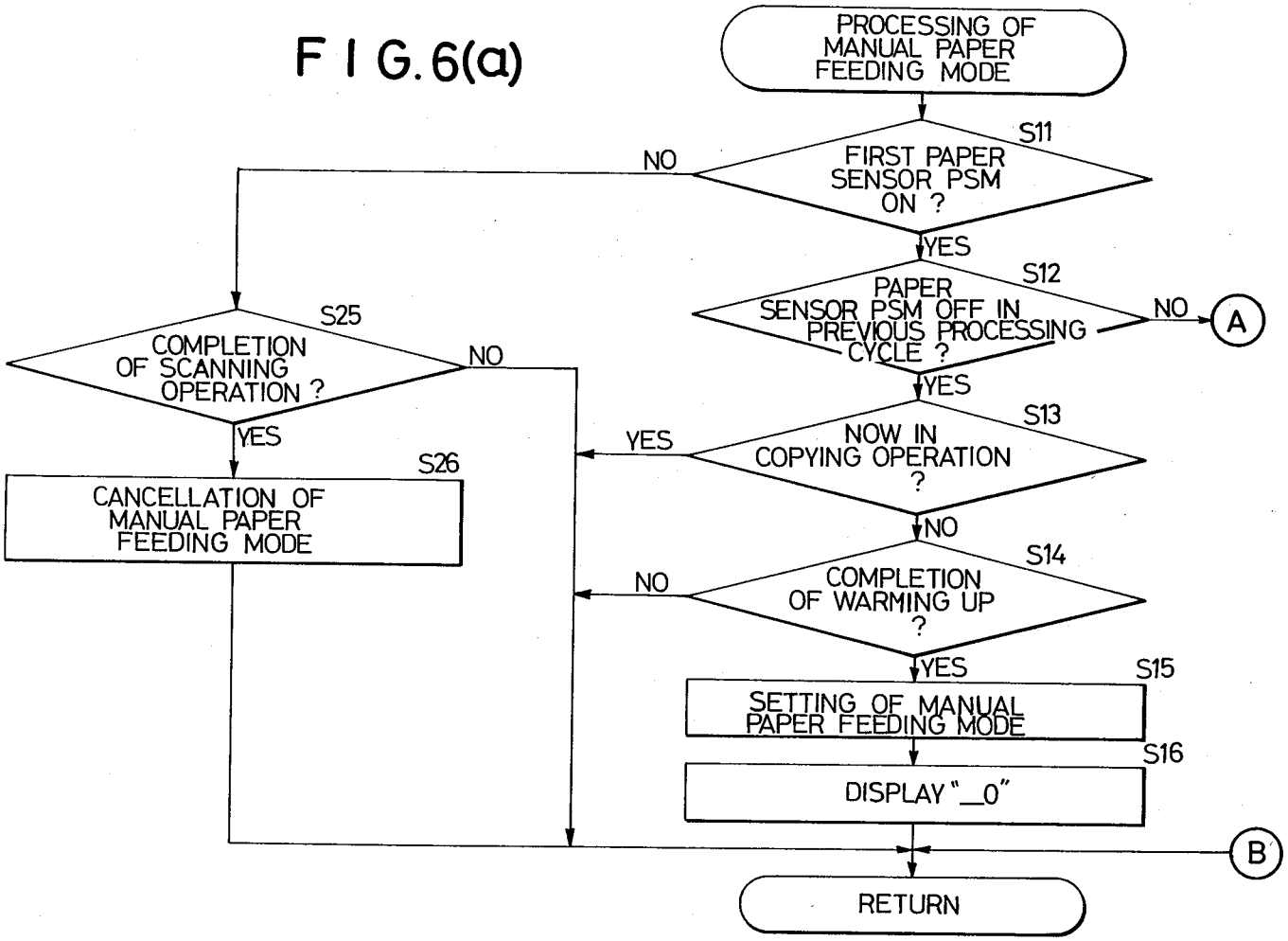
Figure 6B:
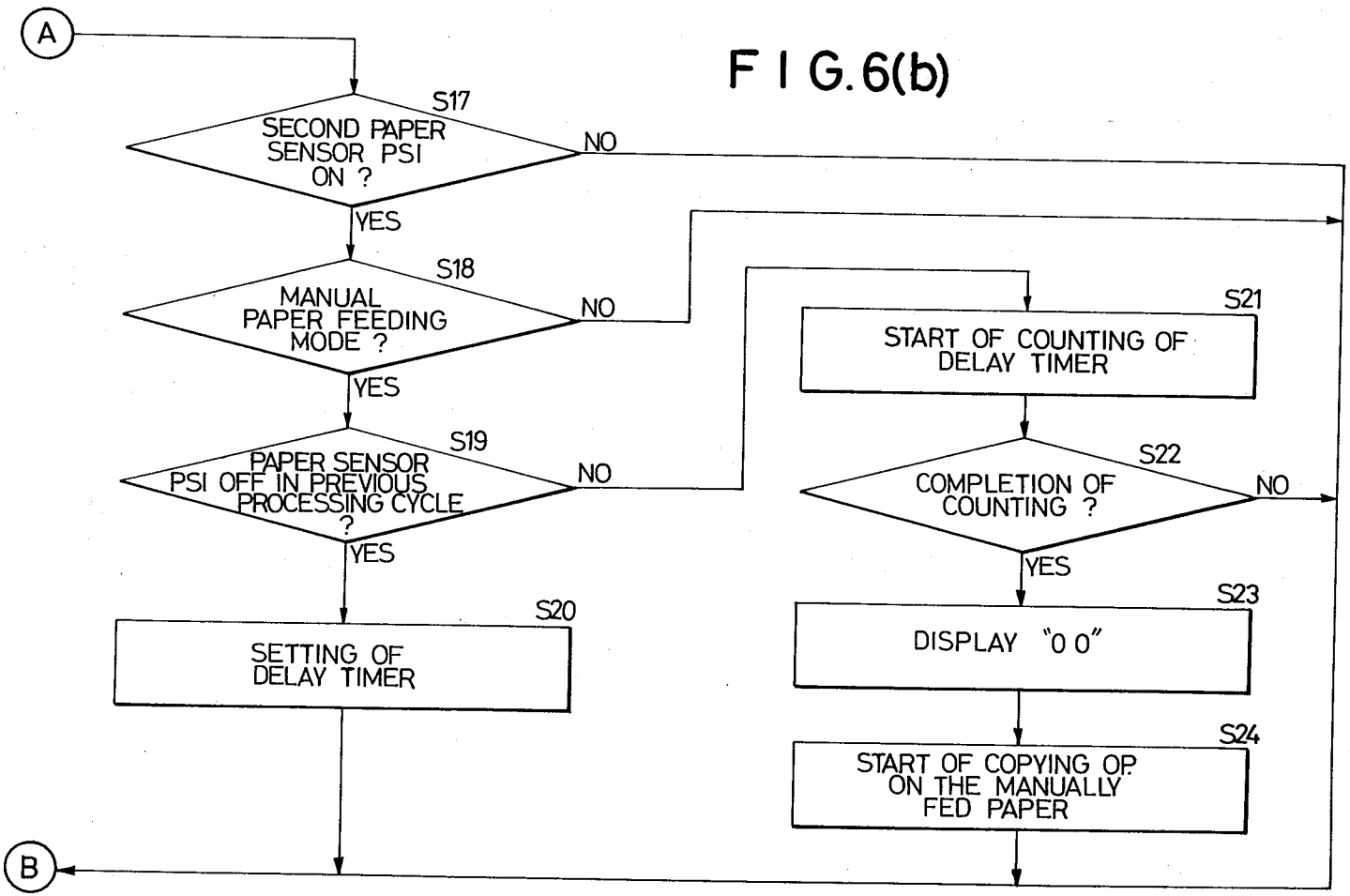

The copying process routine by the manual paper feeding mode will be described in connection with a flow chart of FIGS. 6*a* and 6*b*.

The turn-ON of the first paper sensor PSM for detecting the fact that a copy paper is inserted into a manual paper feeding opening 12 is checked (Step S11). If the sensor PSM is turned ON, it is checked whether the paper sensor PSM was OFF (inoperative) or not in the previous processing cycle of this routine (Step S12). This can be achieved, for example, by checking a flag which has been set when the paper sensor PSM was turned ON in the previous processing cycle.

If the paper sensor PSM was turned OFF in the previous processing cycle, it is checked whether copying operation is being now carried out or not (Step S13). If not, it is checked whether the warming-up of devices, for example, such as completion of heating a fixing roller, has been completed or not (Step S14).

If the warming-up has been completed, a manual paper feeding mode is set (Step S15) and set "_0" on the display portion 25 (shown in FIG. 3(*a*)) (Step S16) and returning to the main routine.

If the copying operation is being now carried out or when the warming-up of the devices has not been completed in the check of Steps S13, S14, control is returned immediately to the main routine.

When the paper sensor PSM is not turned OFF in the previous processing cycle in the check of Step S12, the paper sensor PSI is checked (Step S17). If paper sensor PSI is ON, it means the copy paper has been inserted to the position of the second paper sensor, then, it is checked whether the manual paper feeding mode is set or not (Step S18).

If the mode is the manual paper feeding mode, it is checked whether the paper sensor PSI was OFF in the previous processing cycle or not (Step S19). If it is OFF, the copy paper was not inserted to that position in the previous processing cycle, and is inserted to that position for the first time of the present processing cycle. Therefore, a delay timer for starting the copy operation is set within MPU (Step S20), and operation is returned to the main routine. When the paper sensor PSI is not OFF even in the previous processing cycle, the copy paper has already been inserted to that position. Therefore the counting of the delay timer is started (Step S21) and the termination of counting of the delay timer is checked (Step S22). When the counting is not terminated, control is returned to the main routine but when the counting has been terminated, "00" is set on the display portion 25 (as shown in FIG. 3(*b*)) (Step S23) and the start of the copying operation on the manually fed paper is instructed (Step S24), and then control is returned to the main routine.

When the paper sensor PSI is not ON in Step S17 or the manual paper feeding mode is not set in Step S18, the control is immediately returned to the main routine.

When the first paper sensor PSM is not ON in Step S11, i.e., when the copy paper is fed manually and the tailing end of the paper has passed through the paper sensor PSM, completion of scanning operation is checked (Step S25). If scanning is being now carried out, the control is returned to the main routine but when the scanning has been terminated, the manual paper feeding mode is cancelled (Step S26). Then, the control is returned to the main routine and the copying apparatus enters its waiting state.

Next, the control will be described where a manually fed copy paper was pulled out from the manual paper feeding opening 12.

First, when a manually fed copy paper is pulled out by some reason during the time counting of the delay timer for the starting of copying operation and the first paper sensor PSM is remained ON but the second paper sensor PSI is turned from ON to OFF, thereby, time counting of the delay timer is discontinued, and the delay timer is reset in Step S20. The displayed state on the display portion 25, i.e., "_0" remains unchanged. When the copy paper is inserted manually again in this state and the first paper sensor PSI is turned ON (Step S19), thereby time counting of the delay timer is started (Step S21).

Further, when the manually fed copy paper is completely pulled out from the manual paper feeding opening before starting of copying operation and the first paper sensor PSM is turned from ON to OFF, thereby the displayed state on the display portion 25 and the time counting operating of the delay timer are cancelled and the manual paper feeding mode is also cancelled (Step S26).

Accordingly, the copying operation may be discontinued by pulling out the once inserted copy paper before starting of copying operation. Since the discontinuance of the copying operation is effected before starting of copying operation, it is of course that the jam detecting means will not be actuated.

Next, the control will be described when the manually fed copy paper is pulled out after the time counting of the delay timer is terminated, the indicated state of the display portion 25 is "00", and the copying operation is started.

In this case, the second paper sensor PSI is turned from ON to OFF and state of pulling out of copy paper is detected. However, in this case, the detection function of the jam detection means is cancelled and copying operation is executed on the minimum size of the copy paper. Thereby, useless operation of the copying apparatus may be minimized, and it is not necessary to carry out processing for paper jamming.

FIG. 7 shows a second embodiment in connection with the arrangement of displaying elements indicating the paper feeding state in the manual paper feeding mode. According to this embodiment, when a manually fed copy paper is detected by the first paper sensor PSM, a display element 35 is lit, and when the copy paper is detected by the second paper sensor PSI, a display element 36 is lit. Since these display elements 35 and 36 are provided around the manual paper feeding opening 12, an operator can confirm that the copy paper has been fed sufficiently far enough to the timing roller.

Furthermore, in order to display the feeding state caused by the manual paper feeding, such display can be accomplished by using the display portion 25 for the number of copies in the first embodiment previously described, and also, for example, by using a copying magnification display portion, a copying density display portion, etc.

As described above, according to the present invention, the automatic paper feeding as well as the manual paper feeding are made possible by the plurality of paper sensors only provided on the paper feeding passage without special paper feeding mechanism in the copying apparatus and operator can know whether a copy paper has been properly fed. Therefore, it is possible to design a copying apparatus compactly and to reduce the number of parts.

While the preferred embodiment of the present invention has been described, it is to be understood that modifications will be apparent to those skilled in the art without departing from the spirit of the invention.

What is claimed is:

1. A copying apparatus comprising:

a. a manual paper feeding opening for manual paper feeding mode;

b. a paper transporting passage from the manual paper feeding opening to an image forming portion;

c. a plurality of paper sensor means provided on the paper transporting passage;

d. a display means for displaying the inserting state of a copy paper fed through the manual paper feeding opening; and e. a control means for driving said display means according to the detection signals of said paper sensor means.

2. The copying apparatus as claimed in claim 1, wherein said sensor means comprises at least two sensor means, and said control means displays on the display means at least two states according to the detection signals by said sensor means.

3. The copying apparatus as claimed in claim 2, wherein said display means is a numeral display means for displaying the number of copies.

4. The copying apparatus as claimed in claim 1, wherein said inserting state displayed by said display means is erased when the copy paper fed manually through the manual paper feeding opening was pulled out.

5. A copying apparatus comprising:

a. an image forming means to form an image on a photosensitive member and transfer it onto copy paper;

b. a manual paper feeding opening for manual paper feeding mode;

c. a paper transporting passage from the manual paper feeding opening to the image forming means;

d. a first paper sensor means provided on the paper transporting passage;

e. a second paper sensor means provided on the paper transporting passage and located at a downstream side from said first paper sensor means;

f. a display means for displaying the inserting state of copy paper manually fed through the manual paper feeding opening;

g. a first control means for driving the display means according to detection signals of the first sensor means; and h. a second control means for actuating the image forming means according to detection signals of the second paper sensor means.

6. The copying apparatus as claimed in claim 5, wherein said display means comprise a first and a second display means, the first display means being driven according to detection signals of the first paper sensor means, said second display means being driven according to detection signals of the second paper sensor means.

7. The copying apparatus as claimed in claim 5, wherein the second control means drives the image forming means after a lapse of a predetermined time after the copy paper has been detected by the second paper sensor means.

8. The copying apparatus as claimed in claim 5, wherein the first control means drives the second display means after a lapse of a predetermined time after the copy paper has been detected by the second paper sensor means.

9. A copying apparatus comprising:

a. an image forming means to form an image on a photosensitive member and transfer it on a copy paper;

b. a manual paper feeding opening for manual paper feeding mode;

c. a paper transporting passage from the manual paper feeding opening to the image forming means;

d. paper sensor means provided on the paper transporting passage; and e. control means for actuating the image forming means according to detection signals of the paper sensor means, and actuating the image forming means in a specific mode when the paper sensor means has detected a pulling out of the manually fed copy paper from said manual feeding opening after starting of copying operation.

10. The copying apparatus as claimed in claim 9, wherein the image forming means executes the image forming operation according to the size of copy paper.

11. The copying apparatus as claimed in claim 10, wherein the image forming means for effecting the image forming operation according to the size of copy paper executes the image forming operation on a minimum size of copy paper provided in said copying apparatus when the image forming means is operated in a specific mode.

12. A copying apparatus comprising:

a. an image forming means to form an image on a photosensitive member and transfer it on a copy paper;

b. a manual paper feeding opening for manual paper feeding mode;

c. a paper transporting passage from the manual paper feeding opening to the image forming means;

d. paper sensor means provided on the paper transporting passage;

e. control means for actuating the image forming means according to detection signals of the paper sensor means;

f. paper jamming detection means which detects paper jamming in the paper transporting passages and interrupts the operation of an image forming means when said detection means has detected paper jamming; and g. control means for interrupting the detecting function of the paper jamming detection means and continuing the image forming operation of image forming means when paper sensor means has detected the pulling out of the manually fed copy paper.

13. A copying apparatus as claimed in claim 12, wherein said image forming means executes the image forming operation according to the size of copy paper.

14. A copying apparatus as claimed in claim 13, wherein said control means lets the image forming means execute the image forming operation on a minimum size of copy paper provided in said copying apparatus.

* * * * *